US006793331B2

(12) United States Patent
Anderson et al.

(10) Patent No.: US 6,793,331 B2
(45) Date of Patent: Sep. 21, 2004

(54) IMAGING CARTRIDGE HAVING A LEVEL INDICATOR

(75) Inventors: Bradley J. Anderson, Boise, ID (US); Bruce L. Johnson, Eagle, ID (US); William I. Herrmann, Eagle, ID (US); Leonard T. Schroath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 38 days.

(21) Appl. No.: 10/214,495

(22) Filed: Aug. 8, 2002

(65) Prior Publication Data

US 2004/0027430 A1 Feb. 12, 2004

(51) Int. Cl.[7] ..... B41J 2/175; B41J 2/195

(52) U.S. Cl. ..... 347/86; 347/7

(58) Field of Search ..... 347/7, 19, 85, 347/86, 87; 399/27; 73/290 R, 291, 299, 314, 302; 137/393

(56) References Cited

U.S. PATENT DOCUMENTS 5,315,317 A 5/1994 Terasawa et al. ..... 347/7
5,583,545 A 12/1996 Pawlowski, Jr. et al. ..... 347/7
5,587,770 A 12/1996 Jo et al. ..... 399/27
5,724,627 A 3/1998 Okuno et al. ..... 399/27
5,890,049 A 3/1999 Williams et al. ..... 388/360
6,408,143 B2 * 6/2002 Sakurai et al. ..... 399/27
6,454,375 B2 * 9/2002 Wilson et al. ..... 347/7
6,513,892 B2 * 2/2003 Inoue et al. ..... 347/7

* cited by examiner

*Primary Examiner*—Stephen D. Meier
*Assistant Examiner*—An H. Do

(57) ABSTRACT

An imaging substance cartridge includes a cartridge body that defines an imaging substance chamber. The chamber can contain an imaging substance, as for example toner or liquid ink. The cartridge includes an imaging substance level indication device. The imaging substance level indication device includes a level indication actuator supported in the cartridge body, and which is configured to displace a vapor volume within the imaging substance chamber. The imaging substance level indication device further includes an imaging substance level indicator supported by the cartridge body. The imaging substance level indicator is responsive to the displacement of vapor volume within the imaging substance chamber.

29 Claims, 9 Drawing Sheets

IMAGING CARTRIDGE HAVING A LEVEL INDICATOR

FIELD OF THE INVENTION

The invention claimed and disclosed herein pertains to cartridges for containing an imaging substance (such as ink or toner) used by imaging apparatus to generate an image, and to methods and apparatus for indicating the level of imaging substance with such a cartridge.

BACKGROUND OF THE INVENTION

The present invention pertains to what is commonly known as "printer cartridges" or "imaging cartridges". These cartridges may better be termed "imaging substance cartridges" since they are configured to contain an imaging substance, such as an ink or a toner. The imaging substance is used by an imaging apparatus (defined below) to produce an image on imaging media (such as paper or the like). In order to facilitate handling of the imaging substance by a user of the imaging apparatus, the imaging substance is commonly provided within a container (a "cartridge") that is configured to be installed in, and removed from, the imaging apparatus. The cartridge is typically designed to prevent leakage of the imaging substance from the cartridge when the cartridge is handled by a user or installed in the device, but is also designed to allow the imaging apparatus to selectively remove the imaging substance from the cartridge during an imaging process.

By "imaging apparatus" we mean any apparatus configured to use an imaging substance to generate an image on sheet media, such as on paper or a transparency. Examples of imaging apparatus include (without limitation) printers, photocopies, facsimile machines, plotters, and combinations thereof (i.e., imaging apparatus commonly known as "all-in-one" imaging apparatus or "multifunction peripherals"). Example of imaging processes that can be used by imaging apparatus include electrophotographic imaging, including laser printing, and ink printing, including ink jet printing. Two primary types of imaging substance are provided to imaging apparatus via a cartridge. These primary types of imaging substance include wet ink and dry toner. Dry toner ("toner") is commonly provided as powdered carbon black or very small particles of plastic (as in the case of non-black toners).

When the imaging substance within a cartridge becomes depleted, the user typically replaces the spent cartridge with a replacement cartridge that contains additional imaging substance. The user may not always have a replacement cartridge on hand, or the replacement cartridge may not be easily accessible. Accordingly, a user may be put in the position of not being able to complete an imaging job due to a lack of imaging substance. It is therefore desirable that a user should be able to periodically check the level of remaining imaging substance within an imaging cartridge to thereby have some advance notice of impending depletion of the imaging substance from the cartridge.

A number of different prior art methods and apparatus exist for detecting or estimating the remaining quantity of imaging substance within an imaging cartridge. One such prior art method, described for example in U.S. Pat. No. 5,724,627, uses a "pixel counter". The pixel counter essentially comprises an algorithm which is executed by a processor in the imaging apparatus and which calculates (estimates) the usage of imaging substance based on the number of pixels imaged by the imaging apparatus since the time the current imaging cartridge was installed. However, such pixel counters are not always accurate, with obvious undesirable consequences (specifically, the imaging substance in the cartridge becomes exhausted before the pixel counter indicates it should be exhausted). Another prior art method for allowing a user to determine the remaining imaging substance within an imaging cartridge is to place a transparent or translucent viewing window in the cartridge, such as described in U.S. Pat. No. 5,890,049. However, the imaging substance can coat the inside of the viewing window, making it difficult or impossible to see into the cartridge and thus determine the quantity of imaging substance remaining in the cartridge.

Other prior art level detection devices include sensors placed within the cartridge. One example of this type of level detecting system is described in U.S. Pat. No. 5,587,770, wherein a light-emitting element and a light-receiving element are placed within a toner cartridge. When toner is absent between the two elements (resulting from a low level of toner), the light-receiving element will be able to receive light from the light-emitting element, indicating low toner level. Another sensor-based device is described in U.S. Pat. No. 5,583,545, wherein an electrical device is used in combination with a back-pressure regulator apparatus to sense a back-pressure in the cartridge after the imaging substance has been depleted. The problem with both of these systems is that they typically only alert a user when the cartridge is depleted of imaging substance (or very near depletion). Further, these types of level detection systems add a relatively complex system to what is essentially a consumable component (the cartridge).

What is needed then is a simple, effective way to allow a user to determine the approximate remaining quantity of imaging substance within an imaging cartridge.

SUMMARY OF THE INVENTION

In one embodiment the present invention provides for includes an imaging substance cartridge which includes a cartridge body that defines an imaging substance chamber. The imaging substance chamber can contain an imaging substance, as for example toner or liquid ink. The cartridge includes an imaging substance level indication device. The imaging substance level indication device includes a level indication actuator supported in the cartridge body, and which is configured to displace a vapor volume within the imaging substance chamber. The imaging substance level indication device further includes an imaging substance level indicator supported by the cartridge body. The imaging substance level indicator is responsive to the displacement of vapor volume within the imaging substance chamber.

These and other aspects and embodiments of the present invention will now be described in detail with reference to the accompanying drawings, wherein:

DETAILED DESCRIPTION OF THE INVENTION

The present invention pertains to imaging substance cartridges for use in imaging apparatus. We have described above what we mean by the terms "imaging apparatus", "imaging substance", and "imaging substance cartridge" or "imaging cartridge". These terms will be used in the following description of the present invention. The present invention addresses the problems (described above) associated with prior art imaging substance level detection devices used in imaging substance cartridges. The present invention provides, within the imaging substance cartridge, a simple level indication device. In general, the imaging substance level indication device of the present invention comprises a level indication actuator which displaces a vapor volume within the imaging cartridge, and an imaging level indicator which is responsive to the displacement of volume within the cartridge. The present invention is particularly useful for imaging substance cartridges such as toner cartridges (for use typically in laser imaging apparatus) and wet ink cartridges (for use typically in ink jet imaging apparatus).

We will now describe specific embodiments and examples of the present invention with respect to the accompanying drawings. However, it is understood that the drawings depict only examples of the invention, and should therefore not be understood as limiting the scope of the invention, which is described below and set forth in the claims.

Figure 1:
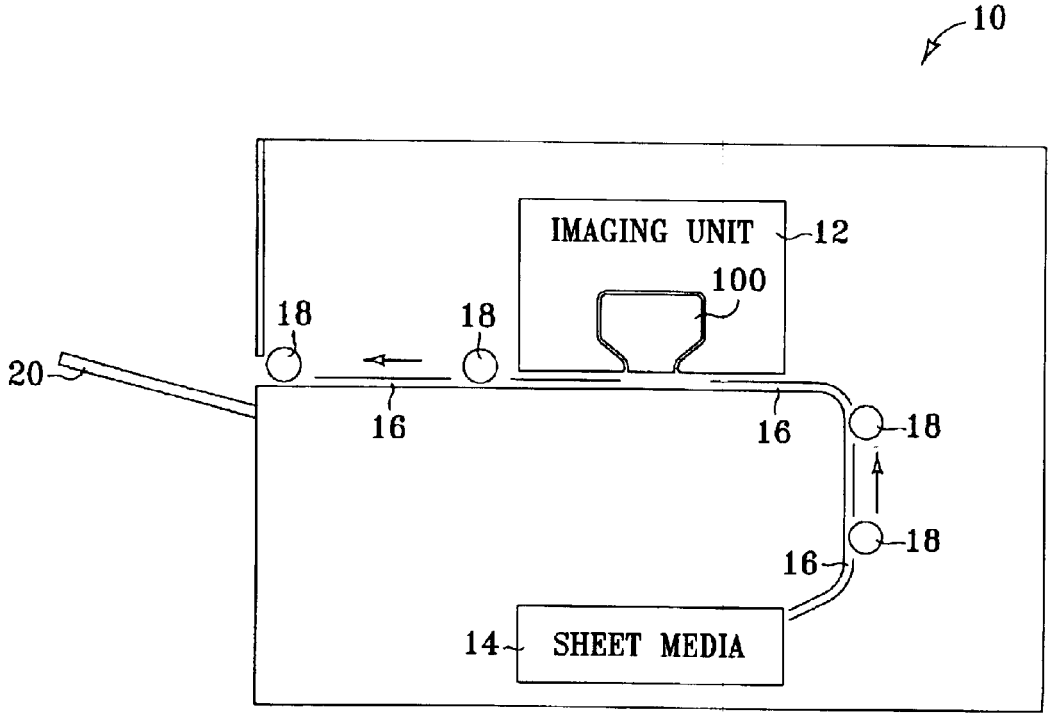
FIG. 1 is a front elevation schematic depicting an imaging apparatus using a toner cartridge.

Turning to FIG. 1, an imaging apparatus 10 is depicted in a front elevation diagram. The imaging apparatus 10 is depicted in a simplified manner and is shown primarily for purposes of setting forth the environment in which imaging substance cartridges of the present invention are used. The imaging apparatus 10 can be an electrophotographic imaging apparatus (such as a laser printer or a laser copier) which moves sheet media 14 along a media path 16 using powered rollers 18. As the sheet media 14 is moved past the imaging unit 12, an imaging substance, such as a toner, is deposited from the imaging substance cartridge ("cartridge") 100 onto the sheet media. The deposition of imaging substance from the cartridge 100 onto the sheet media can be direct, or it can be indirect through the use of an intermediate transfer unit, such as a transfer belt or a transfer drum. The imaged sheet media is then deposited in the output tray 20. In the configuration depicted, the cartridge 100 can be removed from the imaging unit 12 by moving the cartridge out of the plane of the sheet on which the figure is drawn.

The imaging substance level indication device ("level indication device") of the present invention is equally applicable to imaging substance cartridges configured to contain toner (a "toner cartridge") as well as liquid ink (an "ink cartridge"). Accordingly, the level indication device can be known as a "toner level indication device" or an "ink level indication device", depending on the specific application in which the device is used. In general, the imaging substance level indication device of the present invention comprises an imaging substance level indication actuator ("toner level actuator" or "ink level actuator", depending on the application, but more generally "actuator") supported in the cartridge body. The actuator is configured to displace a vapor volume within the imaging substance chamber ("toner chamber" or "ink chamber", depending on the application). The level indication device also includes an imaging substance level indicator ("toner level indicator" or "ink level indicator", depending on the application, or generically, "level indicator") supported by the cartridge body and which is responsive to the displacement of vapor volume within the imaging substance chamber.

Figure 2:
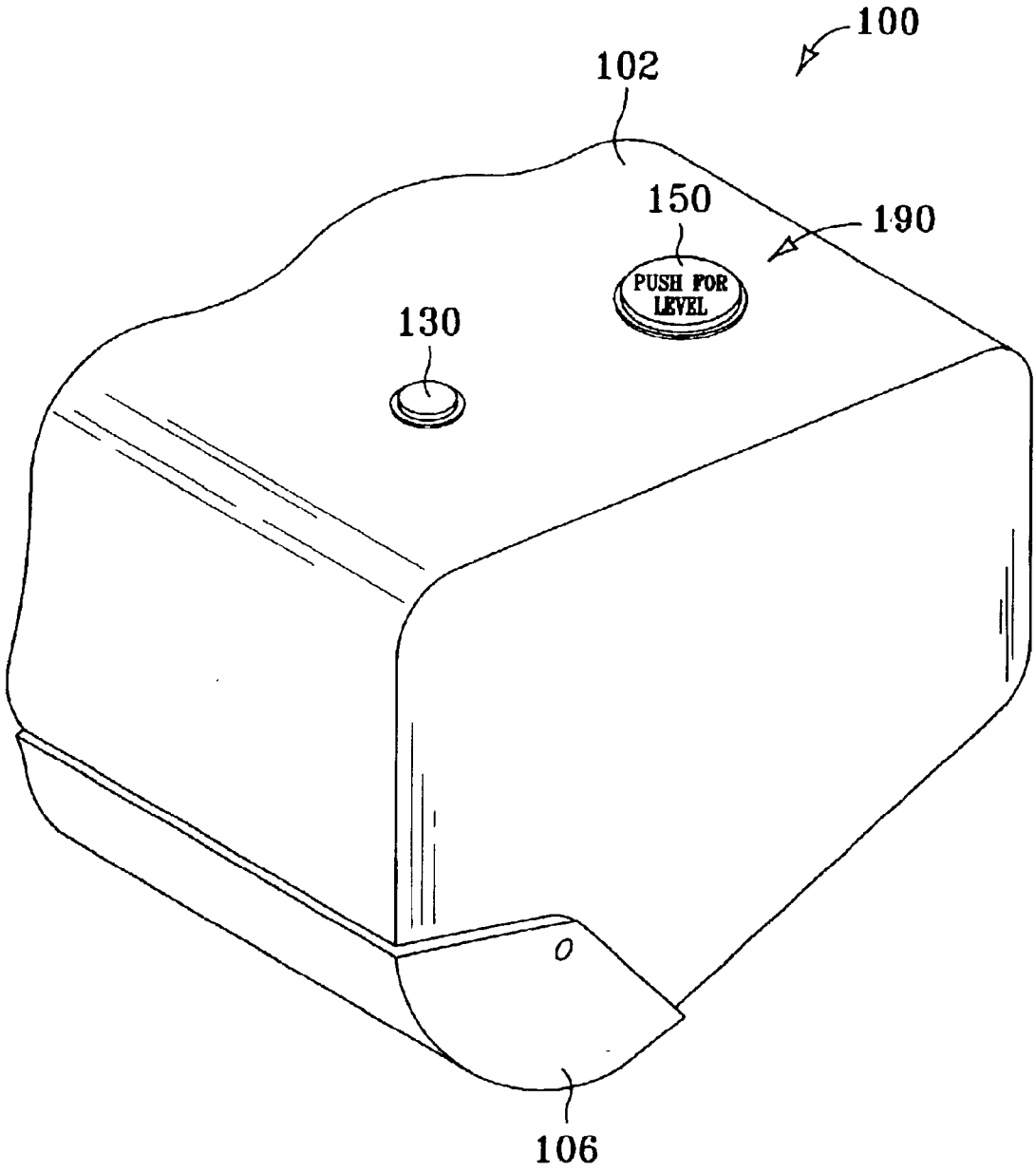
FIG. 2 is an isometric view depicting a portion of the toner cartridge depicted in FIG. 1, and having a toner level indication device in accordance with an embodiment of the present invention.

For purposes of the following discussion, let us assume that the imaging apparatus 10 is a laser imaging apparatus, and the cartridge 100 is a toner cartridge. In this case, the level indication device is a toner level indication device. (We will later describe an embodiment of the present invention wherein the cartridge is a wet ink cartridge, and the level indication device is an ink level indication device.) Turning to FIG. 2, a partial isometric diagram of the toner cartridge 100 of FIG. 1 is shown. The cartridge 100 has a cartridge body 102, which is typically fabricated from one or more plastic components and which supports other components within the cartridge. A moveable door 106 covers an optical photoconductor (described below) which can be part of the cartridge 100. The cartridge 100 includes an imaging substance level indication device 190 in accordance with a first embodiment of the present invention. The level indication device 190 includes an imaging substance level indicator ("level indicator") 130 and a level indication actuator ("actuator") 150, which will be described more fully below. In this embodiment, when a user desires to know the level of toner remaining within the cartridge 100, the user presses down on the actuator 150, which in turn causes the indicator 130 to rise out of the cartridge body 102. The extent to which the indicator 130 protrudes above the body 102 is indicative of the level of toner within the cartridge 100. We will describe the principle of operation further below, but will first describe one embodiment of the present invention in order to facilitate the latter description of the principle of operation.

Figure 3:
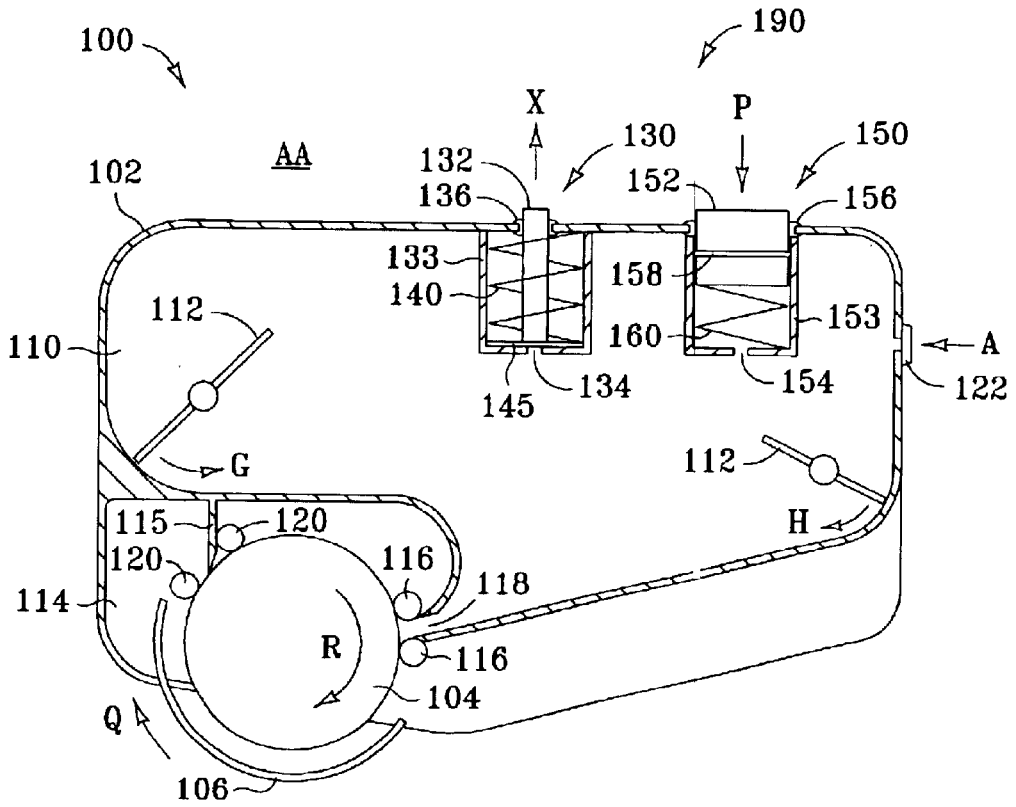
FIG. 3 is a side elevation sectional view depicting the toner cartridge of FIG. 2.

Turning to FIG. 3, a side elevation view of the imaging cartridge 100 of FIG. 2 is depicted in a side elevation sectional view. The cartridge 100 defines an imaging substance chamber 110 which can contain the imaging substance (in this case, toner) which is not shown in the figure. The cartridge 100 further includes an imaging substance (toner) distribution device 104, which is shown here as an optical photoconductor, or "OPC". The OPC 104 is used to extract imaging substance (toner) from the cartridge 100 so that it can be applied to sheet media. Specifically, toner can flow from the toner chamber 110 into the outlet channel 118 where it contacts the OPC 104. Seals 116 prevent the toner from flowing out of the chamber 110 unless the toner is affixed to the OPC by electrostatic adhesion. A moveable cover 106 protects the OPC 104 when the cartridge 100 is removed from the imaging apparatus (10 of FIG. 1), but when the cartridge 100 is installed in the imaging apparatus, the cover 106 moves in direction "Q" to uncover the OPC 104. When the OPC is uncovered, it can be electrographically exposed using a pulsed laser or light emitting diodes (not shown). As the OPC rotates in direction "R", the exposed portions of the OPC will move to the outlet channel 118, where toner will be attracted to, and adhere to, the exposed areas of the OPC 104. In this way toner is extracted from the chamber 110 of the cartridge 100. The cartridge 100 also includes a cleaning station which includes a waste chamber 114 and a doctor blade 115 for scraping residual toner off of the OPC 104 (i.e., toner which has not been transferred from the OPC to sheet media or to an intermediate transfer unit). Seals 120 prevent toner in the waste chamber 114 from migrating out of the waste chamber.

Generally, in the case of a toner cartridge, the toner chamber 110 will be infused with a vapor, such as air. However, due to the potential vapor pressure of the toner, it is more appropriate to state that the imaging substance chamber 110 is infused with a vapor, which can comprise air as well as emissive vapors from the imaging substance. For example, when the imaging substance is liquid ink, the vapor in the imaging substance chamber can comprise vapors from solvents and/or water which keep the coloring constituents of the ink in a liquid solution. When the imaging substance is a toner comprising polymeric particles, the vapor in the imaging substance chamber can comprise vapor from plasticizers which keep the toner particles in a plastic state. Accordingly, it is proper to define the volume within the imaging substance chamber which is not occupied by the imaging substance itself as a "vapor space". As will be described below, the present invention provides an estimation of the remaining imaging substance within the imaging substance chamber by reducing the vapor space or "vapor volume" in the imaging substance chamber by a predetermined volumetric quantity. By reducing the volume of the vapor space in an essentially sealed imaging substance chamber, the pressure within the chamber will be increased (at least temporarily). By measuring this increase in pressure, an approximation can be made of the remaining quantity (i.e., "level") of imaging substance within the imaging substance chamber. This process will be described more fully below.

Generally, when we describe measuring and indicating the "level" of imaging substance within the imaging substance chamber, we mean providing an approximation of the remaining percent of the original volume of imaging substance within the imaging cartridge. For example, if an imaging cartridge contains 0.5 kg (~0.23 lbm) of toner when the cartridge is initially charged (filled) with toner, and if 0.125 kg of toner (i.e., 25% of the original mass of toner) is consumed from the cartridge by usage, then the remaining "level" of toner is 75% (i.e., 75% of the original quantity of toner remains in the cartridge). Accordingly, when we describe an "imaging substance level indication device" in the present invention, we mean a device which is configured to provide an indication (i.e., an approximation) of the "level" (i.e., the remaining percent of the original mass) of the imaging substance within the imaging substance chamber.

The cartridge 100 of FIG. 3 can further include stirring paddles 112 which rotate in directions "G" and "H" to prevent toner from settling in the corners or "dead zones" of the toner chamber 110, and also act to infuse air into the toner to maintain the toner in a semi-fluidic state. This helps the toner to migrate the toner in the chamber 110 towards the toner outlet channel 118. The toner chamber 110 is preferably an essentially sealed, airtight chamber so that a differential pressure can be produced between the ambient air "AA" outside of the toner chamber 110, and the vapor within the toner chamber 110. The cartridge 100 can be further provided with a unidirectional vent valve 122 supported in the cartridge body 102 to allow air "A" to enter the imaging substance chamber 110, but preventing air from escaping from the chamber 110. In this way, as toner is depleted from the cartridge 100 due to usage, ambient air "AA" can be added to the chamber 110 to prevent collapse of the cartridge.

Toner cartridge 100 further includes an imaging substance level indication device 190 (which, for toner cartridge 100, might be more properly described as a "toner level indication device"). (We will also use the abbreviated term "level indication device" for the sake of brevity.) Level indication device 190 includes a level indication actuator 150 supported in the cartridge body 102, and which is configured to displace a vapor volume within the imaging substance chamber 110. The level indication device 190 further includes an imaging substance level indicator (toner level indicator") 130 supported by the cartridge body 102, and which is responsive to the displacement of vapor volume within the imaging substance chamber 110. Thus, as the actuator 150 is operated to displace a vapor volume with the chamber 110, the level indicator 130 will respond by indicating to a user the approximate level of toner remaining in the cartridge 100.

Figure 4:
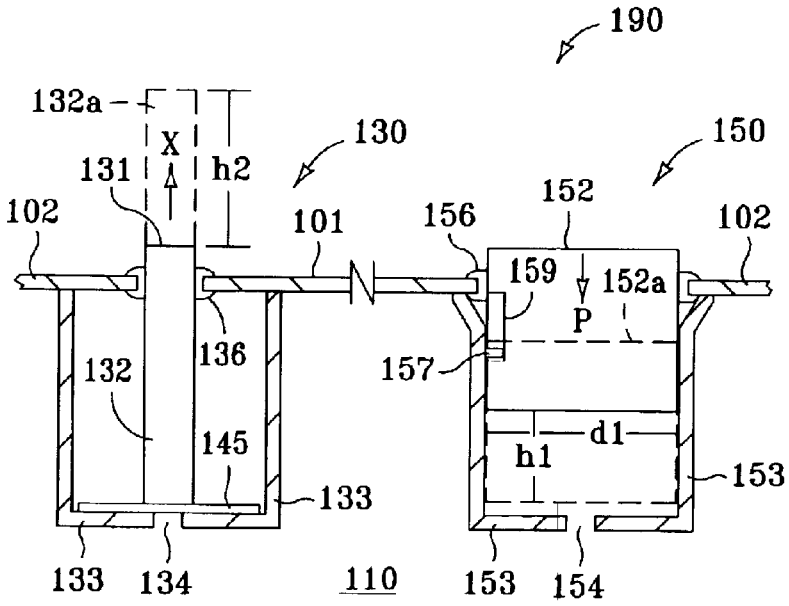
FIG. 4 is a detail diagram depicting the level indication device used in the toner cartridge of FIG. 3.

More specifically, the level indication actuator 150 can comprise a piston 152 supported in the cartridge body 102. As depicted in FIG. 4, the piston 152 can be moveable from a first position (shown by solid lines) to a second position (shown by dashed lines as 152*a*). When the piston 152 is moved in direction "P" from the first position to the second position, the piston moves into the imaging substance chamber 110 to thereby displace a vapor volume. In the instance depicted in FIG. 4, if the piston is round and of a diameter of "d1" and moves a distance "h1" into the chamber 110, then the vapor volume that will be displaced by the piston 152 is $dv_1=\pi(d1)^2(h1)/4$. As shown in FIGS. 3 and 4, the level indication actuator 150 can further include an actuator sleeve 153 supported by the cartridge body 102. The actuator sleeve 153 receives the piston 152 and supports the piston within the imaging substance chamber 110. An opening 154 in the bottom of the sleeve 153 allows vapor within the chamber 110 to move out of the central opening defined by the sleeve 153, responsive to movement of the piston 152 from the first position to the second position (position 152*a*, FIG. 4). The opening 154 also allows vapor to move from the chamber 110 into the central opening in the sleeve 153 when the piston 152 is returned to the first position. The level indication actuator 150 can also be provided with an actuator vapor seal 156 which is disposed between the piston 152 and the cartridge body 102 to thereby contain vapor (and toner) within the imaging substance chamber 110. A secondary seal can also be provided, such as o-ring 158 (FIG. 3) which fits around the piston 152 and contacts the inner surface of sleeve 153. The level indication actuator 150 is preferably provided with an actuator biasing member (spring 160) in contact with the piston 152 and configured to urge the piston to the first position (i.e., out of the imaging substance chamber 110, as depicted in FIG. 3). In this way, after a user presses the actuator piston 152 down in direction "P" to the position indicated as 152*a* in FIG. 4, and then releases the piston, the piston will be returned to the first position (as depicted in FIG. 3). Piston 152 can be secured in the sleeve 153 by a restraining member, such as pin 157 (FIG. 4) which is supported on the inner surface of sleeve 153 and fits within a delimited slot 159 in the piston. In addition to the embodiment of the level indication actuator 150 depicted in FIGS. 3 and 4, additional embodiments of level indication actuators will be described below.

As depicted in FIG. 4, the imaging substance level indicator 130 can comprise an elongated member 132 moveably supported in the cartridge body 102. The elongated member 132 has a first end 145 exposed to the imaging substance chamber 110, such that a pressure increase within the imaging substance chamber 110 will cause the elongated member 132 to move within the cartridge body 102. This movement will be described more fully below, but in general is the movement which is responsive to the displacement of vapor volume in the chamber 110 due to moving the actuator 150 from the first position to the second position, as described above. Similar to the piston 152, the toner level indicator 130 can include an indicator vapor seal 136 which is placed between the elongated member 132 and the cartridge body 102, to thereby contain vapor (and toner) within the imaging substance chamber 110. As shown in FIGS. 3 and 4, the level indicator 130 can further include an indictor sleeve 133 supported by the cartridge body 102. The indicator sleeve 133 can receive the elongated member 132 and also supports the elongated member within the imaging substance chamber 110. An opening 134 in the bottom of the indicator sleeve 133 allows vapor within the chamber 110 to enter into the central opening defined by the sleeve 133, responsive to an increase of pressure within the chamber 110. This movement of vapor into the opening in the sleeve 132 causes the elongated member 132 to move in direction "X" from a first position (depicted in FIG. 4 by solid lines as 132) to a second position (depicted by dashed lines as 132*a*). The opening 134 also allows vapor to move from the central opening in the sleeve 133 into the chamber 110 when the elongated member 132 is returned to the first position (position 152, FIG. 4). The level indicator 130 is preferably provided with an indicator biasing member (e.g., spring 140 of FIG. 3) which is in contact with the elongated member 132 and is configured to urge the elongated member to the first position (i.e., into the imaging substance chamber 110 as depicted in FIG. 3). As depicted, the spring 140 acts against the cartridge body 102 and a flange 145 which is attached to the bottom of the elongated member 132. In this way, after a user releases the actuator piston 152 from the second position (152*a*, FIG. 4), the elongated member 132 will be returned to its first position (i.e., the position depicted in FIG. 3). The elongated member 132 can be secured in the sleeve 133 by a restraining member, such as flange 145 (FIGS. 3 and 4).

Figure 5:
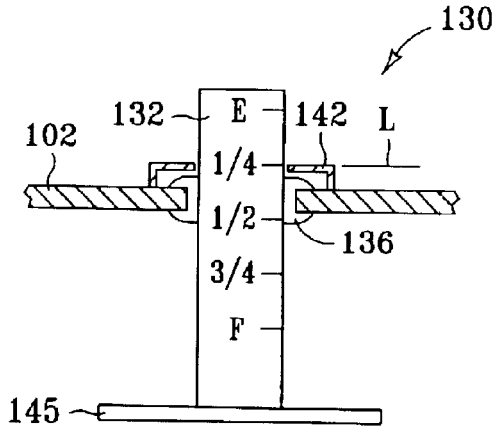
FIG. 5 is a side elevation detail diagram depicting a variation of the toner level indicator used in the toner level indication device of FIG. 4.

In the example depicted in FIGS. 3 and 4 the cartridge body 102 is defined by an outer surface 101 (FIG. 4), and the elongated member 132 has a second end 131 which moves away from the cartridge body outer surface when the elongated member 132 is subjected to an increase in pressure within the imaging substance chamber 110. That is, an increase in pressure within the chamber 110 causes the elongated member 132 to rise above (or "pop-up" from) the cartridge body 102. As will be described more fully below, the distance or height "h2" (FIG. 4) that the elongated member 132 rises from the outer surface 101 of the cartridge body 102 is indicative of the level of imaging substance (toner or ink) within the cartridge 102. The height "h2" can define a length of the elongated member 132 which can protrude out of the cartridge body 102. As depicted in FIG. 5, the elongated member 132 can be marked with graduations along the length which are indicative of a level of imaging substance contained within the imaging substance chamber 110. For example, the elongated member can be marked with graduations "E", "¼", "½", "¾", and "F". The marking "F" indicates that the cartridge 100 is essentially full of toner or imaging substance, while the marking "¾" indicates the cartridge contains approximately three-fourths of the original charge of imaging substance, and so on to marking "E", wherein the graduation indicates that the cartridge 100 is essentially depleted of imaging substance. A level marker 142 can be connected to the cartridge body 102 to facilitate reading of the graduations marked on the elongated member 132. A user can thus align the level marker 142 with the graduation on the elongated member 132 at level line "L" to read the level indicated by the graduation. In addition to the embodiment of level indicator 130 depicted in FIGS. 3–5, additional embodiments of level indicators will be described below.

In general, the present invention works on the principle of the ideal gas law for a closed system of constant temperature. Such a system can be mathematically represented by the equation $P_1V_1=P_2V_2$. In the present invention, the volumes $V_1$ and $V_2$ can represent the vapor volume within the imaging substance chamber (e.g., chamber 110 of FIG. 3), and $P_1$ and $P_2$ can represent the pressure within the chamber corresponding to respective volumes $V_1$ and $V_2$. That is, volume $V_1$ and pressure $P_1$ correspond to the respective volume and pressure of the imaging substance chamber when the level indication actuator (e.g., 150, FIG. 4) is in the first position, and volume $V_2$ and pressure $P_2$ correspond to the respective volume and pressure of the chamber when the level indication actuator is in the second position. Thus, by moving piston 152 (FIG. 4) into the chamber 110 to the position indicated by 152*a* (FIG. 4), the volume of the chamber 110 is reduced by $dv_1$, as described above. With respect to FIG. 6A, which depicts a simplified schematic diagram of the toner cartridge 100 of FIG. 3, and shows the piston 152 in the second position, $V_2$ corresponds to V1, and $V_1$ corresponds to $V1+dv_1$. Pressure $P_2$ corresponds to the depicted situation (with piston 152 in the second position), while pressure $P_1$ corresponds to the situation depicted in FIG. 3 (where the piston 152 is in the first position). Accordingly, for the situation depicted in FIG. 6A, the pressure $P_2$ within the chamber is defined by the equation $$P_2=P_1(V1+dv_1)/(V1)$$

This increase in pressure (from $P_1$ to $P_2$) acts on the level indicator (in FIG. 6A, the elongated member 132) to overcome the mass of the elongated member (and the force of the biasing member (spring 140 of FIG. 3), if any) to push the elongated member 132 out from the cartridge body 102 in direction X1.

Figure 6A:
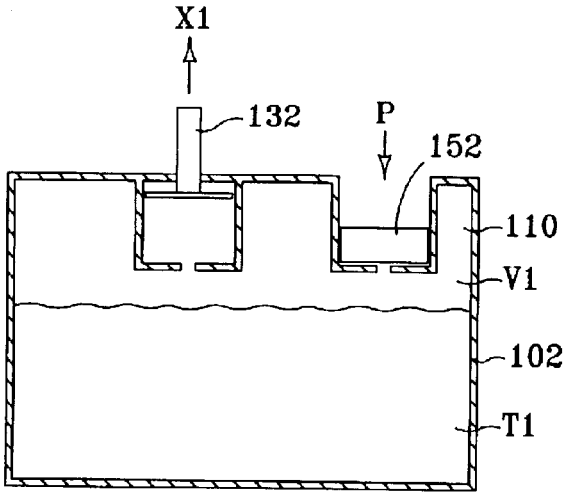
FIG. 6A is a side elevation schematic diagram depicting how the level indication device of FIG. 4 operates when a relatively high level of toner is present in the imaging cartridge.
Figure 6B:
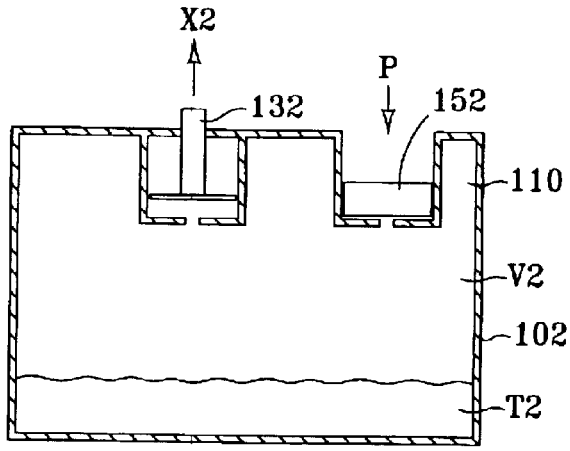
FIG. 6B is a side elevation schematic diagram depicting how the level indication device of FIG. 4 operates when a relatively low level of toner is present in the imaging cartridge.

As imaging substance is removed from the imaging cartridge by usage, the vapor volume in the imaging substance chamber will be increased (although the volume of the chamber itself remains constant). Viewing FIGS. 6A and 6B, it can be seen that the imaging substance (toner) has been drawn down from a toner mass (and corresponding toner volume) T1 (FIG. 6A) to a toner mass (and volume) of T2 (FIG. 6B). Accordingly, the vapor volume V of the chamber 110 increases as imaging substance is removed from the cartridge. As the vapor volume increases (e.g., from V1 of FIG. 6A to V2 of FIG. 6B), the effect of decreasing the volume within the chamber 110 by depressing the piston 152 will be reduced. Using the above equation (i.e., $P_2=P_1(V1+dv_1)/(V1)$), the pressure $P_2$ for the scenario depicted in FIG. 6B is $P_2=P_1(V2+dv_1)/(V2)$. Let us define the pressure for the system depicted in FIG. 6A as $P1_2$, and the pressure for the system depicted in FIG. 6B as $P2_2$. Since in both instances the pressure before moving the piston to the deployed position (as depicted) will be essentially the same (typically atmospheric), the ratio of the pressure $P1_2$ to $P2_2$ becomes $[(V1+dv_1)/(V1)]/[(V2+dv_1)/(V2)]$. Accordingly, when V1 is small as compared to V2, the effect of adding $dv_1$ to the vapor volume will produce a much larger increase in pressure $P_2$. For example, assume that when the cartridge 100 is nearly full of toner volume V1 is 1, and when the cartridge is nearly depleted of toner the volume V2 is 4. Let us also assume that $dv_1$ (the volume displaced by piston 152) is constant at 0.125. Then $P1_2$ will be equal to 1.125, and $P2_2$ will be equal to 1.031. The higher pressure $P1_2$ will cause the elongated member 132 to be moved distance "X1" as in FIG. 6A, while the lower pressure $P2_2$ will only cause the elongated member 132 to be moved distance X2 as in FIG. 6B. The markings on the elongated member 132 depicted in FIG. 5 show how this relationship can thus be used to provide an indication of the level of imaging substance remaining in the imaging substance chamber 110 by using a level detection system of the present invention.

As indicated previously, the amount of movement of the level indicator 130 in response to the increase in pressure will be dependent on the amount of the pressure increase, as well as resistance to movement exhibited by the level indicator. Resistance to movement can be the result of frictional forces (e.g., between the indicator seal 136 and the elongated member 132 (FIG. 3)), the force of the indicator spring 140, and the mass of the elongated member 132. If significant resistance is present in the indicator system, then the indicator will move very little in response to the change in pressure due to actuation of the level actuator 150. However, in order to provide a user with good visual detection of the approximate level of imaging substance in the cartridge, it is preferable to configure the indicator to move a visually significant distance when displaying the range between an indicated "full" condition and an indicated 'empty" position. Accordingly, it is preferable to design the components of the level indicator 130 such that the level indicator does not present a significant resistance to movement resulting from a pressure increase in the substance chamber (being the result of actuation of the level actuator 150).

Since the level indication device of the present invention relies on a temporary increase in pressure within the imaging substance chamber in order to move the level indicator, it is preferable to design the imaging substance level indicator, and the imaging substance cartridge, so that they form an essentially airtight system when the imaging substance level indication device is being used. Points where air can escape from the cartridge include at the level indication actuator 150 (FIG. 3), at the level indicator 130, and at the OPC 104. A number of different configurations can be provided to this end, which will now be described.

Figure 9:
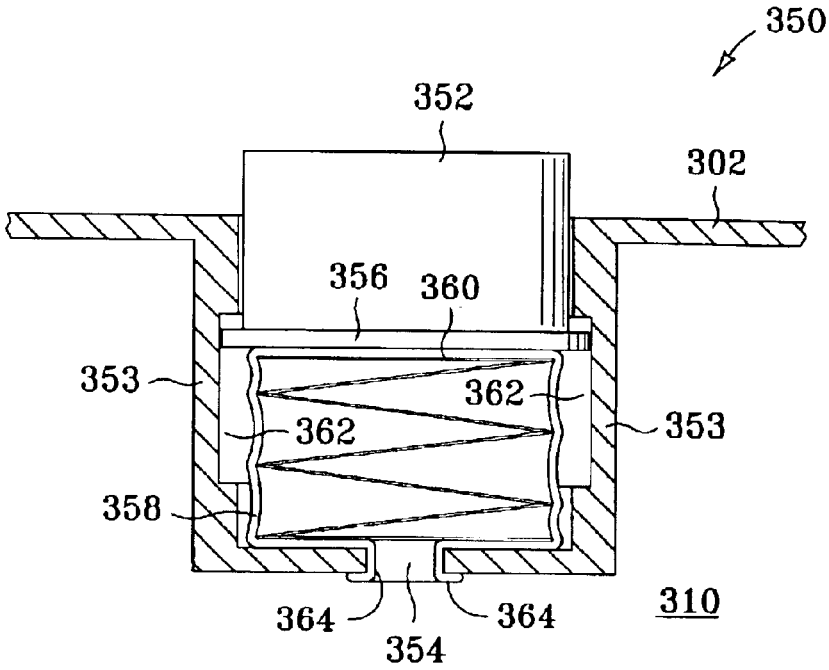
FIG. 9 is a side elevation sectional view depicting a toner level indication actuator that can be used in with a toner level indication device in accordance with the present invention.

Turning to FIG. 9, a side elevation view of a level indication actuator 350 is depicted. The level indication actuator 350 works on generally the same principle as the level indication actuator 150 of FIG. 3, described above. That is, the actuator 350 includes a piston 352 which is moveably supported by the cartridge body 302 in an actuator sleeve 353, allowing the piston to move into the imaging substance chamber 310. The actuator 350 further includes an actuator bellows 358 which is disposed between the piston 352 and the imaging substance chamber 310. The actuator bellows 358 is vapor sealed to the imaging substance chamber 310, as for example by seal 364 which fits around opening 354 in the bottom of the sleeve 353. The opening 354 allows vapor to enter and leave the bellows 358. The piston 352 can be provided with a bottom flange 356 which can be used to provide an even distribution of force on the bellows 358 when the piston is pushed down into the sleeve 353. The bottom flange 356 can also fit into a delimited cutout area 362 in the sleeve 353. The delimited cutout area 362 not only constrains the piston 352 in the sleeve, but also establishes a fixed range of movement of the piston, and consequently a constant vapor volume will be displaced each time the piston is moved to the second position (e.g., position 152*a* of FIG. 4). Bellows 358 can be provided with an internal spring or biasing member 360, which acts to bias the piston 352 into the first position, and also helps to beep the bellows 358 biased to a distended shape (as depicted). Bellows 358 can also be made of a pre-formed plastic or elastomeric material such that a separate spring member 360 is not required to bias the bellows in the distended position.

Figure 10:
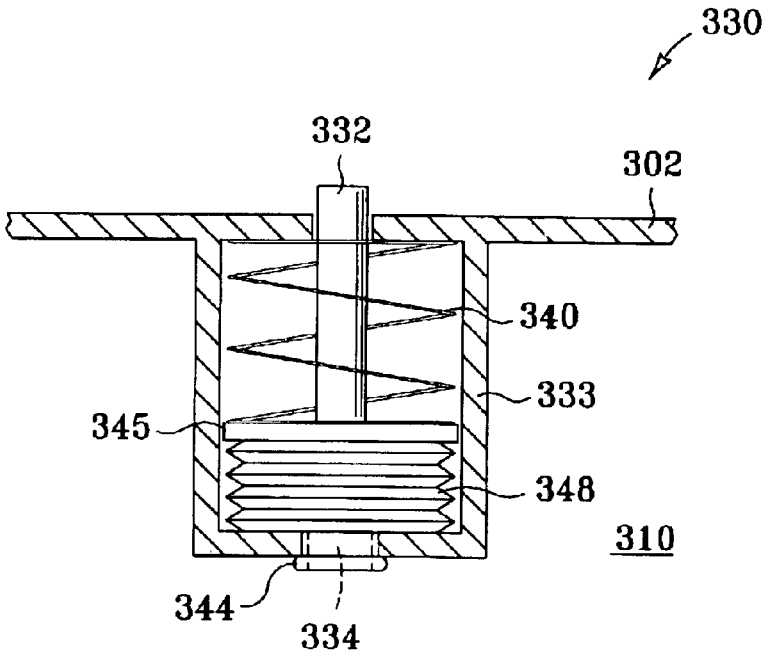
FIG. 10 is a side elevation sectional view depicting a toner level indicator that can be used in an imaging substance level indication device in accordance with the present invention.

In a similar manner, the level indication device of the present invention can be provided with a bellows at the level indicator to seal the imaging substance chamber at the level indicator. Turning to FIG. 10, a side elevation view of a level indicator 330 is depicted. The level indicator 330 works on generally the same principle as the level indicator 130 of FIG. 3, described above. That is, the indicator 330 includes an elongated member 332 which is moveably supported by the cartridge body 302 in an indicator sleeve 333, allowing the elongated member to move out of the imaging substance chamber 310. The indicator 330 further includes an indicator bellows 348 which is disposed between the elongated member 332 and the imaging substance chamber 310. The indicator bellows 348 is vapor sealed to the imaging substance chamber 310, as for example by seal 344 which fits around opening 334 in the bottom of the sleeve 333. The opening 334 allows vapor to enter and leave the bellows 348. The elongated member 332 can be provided with a bottom flange 345 which can be used to allow the bellows 348 to provide an even distribution of force on elongated member 332 when the bellows pushes the elongated member 332 out of the sleeve 333. The bottom flange 345 can also constrain the elongated member 332 in the cartridge body 302. An external spring 340 can be provided between the cartridge body 302 and the bottom flange 345 to maintain the bellows 348 in a default collapsed position, and the elongated member 332 in a retracted position, until acted on by an increase in pressure in the chamber 310 due to the actuator (350, FIG. 9) being actuated. Bellows 348 can also be made of a pre-formed plastic or elastomeric material such that a separate spring member 360 is not required to bias the bellows in the collapsed position.

Figure 14:
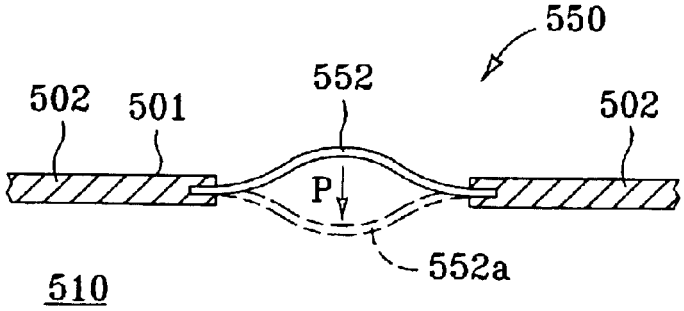
FIG. 14 is a side elevation detail diagram depicting a variation of a toner level indication actuator that can be used in the toner level indication device of FIG. 4.

Turning briefly to FIG. 14, a side elevation sectional view of yet another configuration of a level indication actuator in accordance with the present invention is depicted. The actuator 550 of FIG. 14 includes diaphragm 552 biased to protrude outward from the outer surface 501 of the cartridge body 502. The diaphragm 552 is moveable in direction "P" from a first position (indicated by solid lines) to a second position (indicated by dashed lines as 552*a*) so as to intrude within the imaging substance chamber 510. In this way the actuator 550 can displace a known vapor volume within the chamber 510, yet maintain an essentially airtight seal between the chamber 510 and the cartridge body 502. Since the diaphragm 552 has a pre-shaped bias, it will return to the original position (depicted by solid lines) once released by the user.

In addition to the "pop-up" type of level indicator depicted in FIGS. 3, 5 and 10 (as 130 and 330), other embodiments of level indicators can be used. One such alternate embodiment is depicted in the side elevation sectional view of toner cartridge 200 of FIG. 7. The imaging substance ("toner") cartridge 200 is provided with an imaging substance level indication device 290, which includes a level indication actuator 250 and a level indicator 230. The actuator 250 is essentially the same as the actuator 150 depicted in FIG. 3 and described above. That is, the actuator 250 includes a piston 252 which is supported by the cartridge body 202 in an actuator sleeve 253, allowing the piston 252 to move into the cartridge chamber 210. A bottom opening 254 in the actuator sleeve 253 allows vapor from the chamber 210 to move into and out of the central area defined by the sleeve 253. An actuator spring 260 biases the piston 252 in the "upward" position, so that when a user presses downward in direction "P" the piston will be moved downward to displace a vapor volume in the chamber 210.

Figure 7:
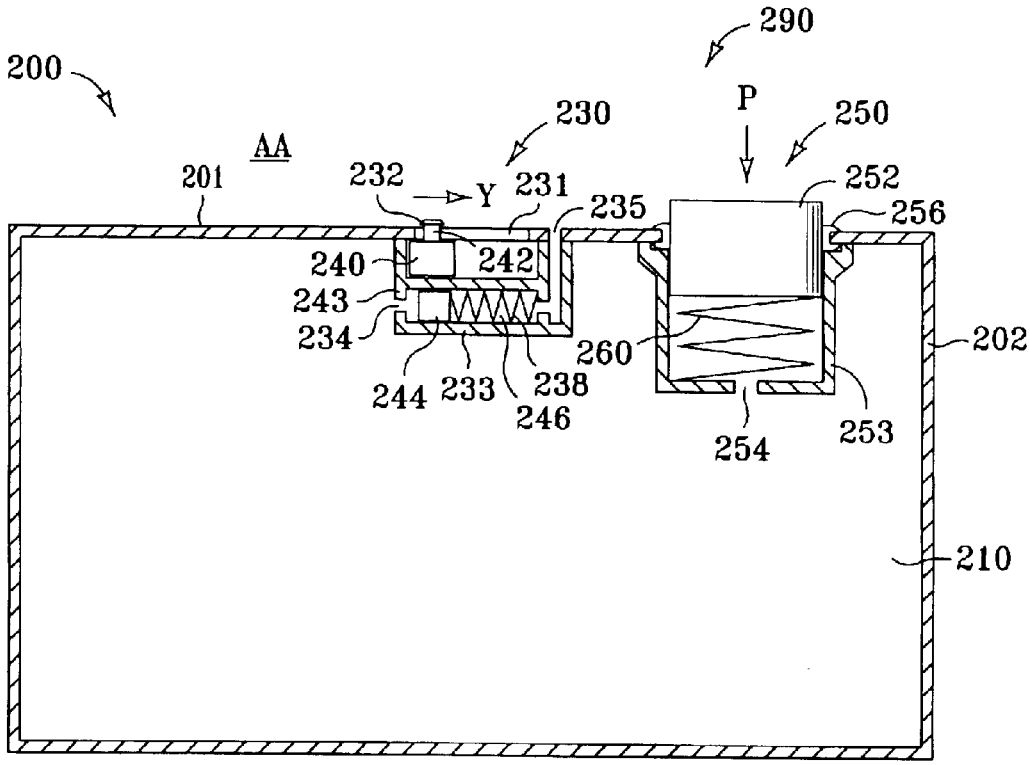
FIG. 7 is a front elevation sectional view depicting a toner cartridge having a toner level indication device in accordance with another embodiment of the present invention.
Figure 8:
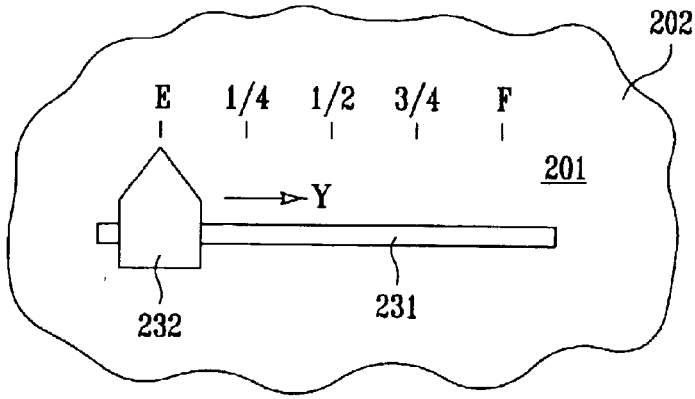
FIG. 8 is a plan view depicting a toner level indicator used in the toner level indication device of FIG. 7.

Cartridge 200 further includes the level indicator 230, which is a sliding-type of indicator, versus the "pop-up" type of indicator 130 of FIG. 3. Indicator 230 of FIG. 7 includes a slidingly moveable member 232 which is used to visually display to a user the approximate level of imaging substance in the cartridge when the actuator 250 is operated. Turning briefly to FIG. 8, a plan view of the outer surface 201 of the cartridge body 202 in the area of the level indicator 230 of FIG. 7 is depicted. As can be seen, the sliding member 232 can move in direction "Y" with respect to the cartridge body 202 to thereby provide visual indication to a user of the approximate level of imaging substance within the cartridge. Indicia can be applied to the outer surface 201 of the cartridge body 202 to provide the user with a quantitative approximation of the level of imaging substance in the cartridge, from empty ("E") to full ("F"), with fractions of the "fullness" in between (e.g., "¼" for one fourth full).

The sliding member 232 moves in response to the actuation of the level indication actuator 250 in the manner described above with respect to FIGS. 6A and 6B. Several variations can be employed to producing sliding movement of member 232. In one variation a first magnet 240 is connected to the slidable member 232 of the imaging substance level indicator 230. The slidable member 232 is free to slide within the channel 231 formed in the cartridge body. The magnet 240, and the slidable member 232, are received within a housing 243 which is supported by the cartridge body 202. The housing 243 forms an essentially airtight seal between the cartridge chamber 210 and the area "AA" outside of the cartridge 200. A second magnet 244 is moveably supported within the imaging substance chamber 210 by indicator body 233. An opening 234 in the indicator housing 233 allows vapor pressure within the chamber 210 to act on the second magnet 244. The second magnet 244 is in proximity to the first magnet 240 to cause the first magnet 240 (and hence the sliding member 232) to move in conjunction with movement of the second magnet 244. Moreover, the second magnet 244 is movable in response to the displacement of volume within the imaging substance chamber 210 resulting from operation of the actuator 250. In this way the sliding member 232 can be moved to provide a visual indication of the level of imaging substance within the cartridge 200. The second magnet 244 can be biased to a first position (being the position depicted in FIG. 7) by indicator spring 238 which is placed in the indicator body 233. Preferably, the interior 246 of the indicator body 233 is vented to the ambient air "AA" by a vent 235. While the interior 246 of the indicator body 233 can be sealed with respect to the ambient air "AA" (thereby providing a truly airtight level indicator), pressure buildup within the interior 246 of the indicator body 233 resulting from rightward movement of the second magnet 244 will inhibit significant further movement of the magnet 244. Additionally, unless the magnet 244 is provided with a seal to isolate the chamber 210 from interior 246 of the indicator body 233, little or no movement of magnet 244 will result from a pressure change within the chamber 210 due to actuation of actuator 250 (since movement of the sliding member 232 results from a pressure differential between the chamber 210 and the ambient "AA"). Accordingly, in the preferred configuration the interior 246 of indicator body 233 is vented, and magnet 244 is sealingly contained within indicator body 233 such that vapor within the chamber 210 will not pass by the magnet 244 and out of the vent 235.

Figure 12:
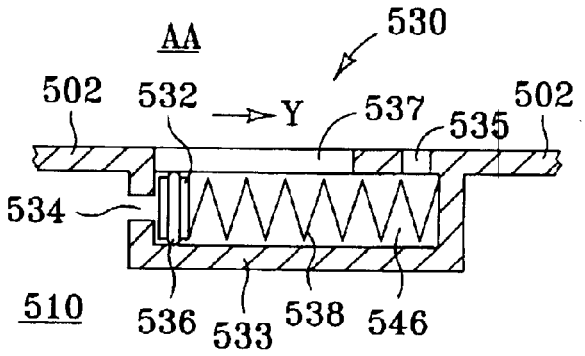
FIG. 12 is a side elevation detail diagram depicting a variation of a toner level indicator that can be used in the toner level indication device of FIG. 4.

FIG. 12 depicts a side elevation, sectional view of another variation of a sliding-type level indicator that can be used with the present invention. The level indicator 530 of FIG. 12 includes a sliding member 532 that can move in direction "Y" with respect to the cartridge body 502 in response to actuation of the level indication actuator (which can be of any of the forms described herein, such as actuator 250 of FIG. 7). As with the level indicator 230 of FIGS. 7 and 8, the outer surface of the cartridge body 502 can be marked with level indicia (as in FIG. 8). However, in the level indicator 530 of FIG. 12, the sliding member 532 is located behind a transparent window 537 which is secured in the cartridge body 502. Preferably, the sliding member 532 is colored a contrasting color from the color of the cartridge body 502 to thereby enhance visual perception by the user of the indicated level of imaging substance remaining in the cartridge. As depicted in FIG. 12, the sliding member 532 is received within indicator body 533, which is disposed within the chamber 510 of the cartridge. An opening 534 is provided in the indicator body 533 to allow pressure within the chamber 510 to act on the sliding member 532. The level indicator 530 can be provided with a level biasing member (spring 538) to bias the sliding member 532 towards the passive state (i.e., the position the sliding member occupies when the level indicator actuator is not being actuated, which is towards the left in FIG. 12). As with the level indicator 230 of FIG. 7, preferably the interior 546 of the indicator body 533 (i.e., the area separated from the chamber 510 by the sliding member 532) is isolated from the chamber 510 by a seal 536. More preferably (and similar to actuator 230 of FIG. 7), the interior 546 of the indicator body 533 is vented to the ambient "AA" by vent 535 to allow a greater range of movement of the sliding member 532 in response to an increase in pressure within the chamber 510 (resulting from actuation of the level indication actuator).

Figure 13:
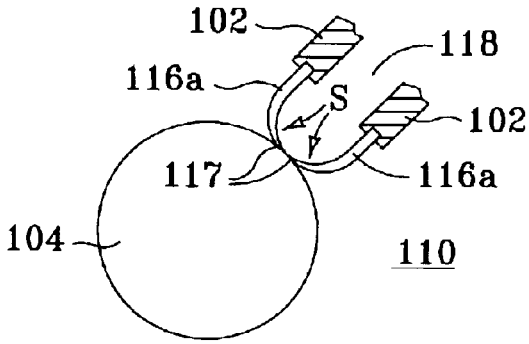
FIG. 13 is a side elevation detail depicting a seal that can be used in a toner cartridge at an optical photoconductor.

As mentioned earlier, another area within a toner cartridge where it is preferable to provide an essentially airtight seal between the imaging substance chamber and the ambient is at the OPC (104, FIG. 3). The OPC 104 is preferably configured to move rotationally with respect to the cartridge body 102 to thereby allow toner to move out of the chamber 110. Seals 116 prevent toner from migrating out of the chamber 110 unless adhered to the OPC 104 via an electrical charge. Preferably, seals 116 are configured to allow a slight increase in pressure within the chamber 110 to thereby allow the level indication device 190 to operate in the manner generally described above with respect to FIGS. 6A and 6B. If an insufficient seal is provided at the OPC 104, then when the actuator 150 is cycled the resulting increase in pressure within the chamber 110 can force toner from the chamber out past the OPC. This is undesirable for obvious reasons. One manner in which the seals around the OPC 104 can be configured to prevent the escape of toner, while still providing a seal that allows the OPC to operate to move toner out of the chamber 110, is depicted in FIG. 13. FIG. 13 depicts a side elevation sectional view of seal 116A which is secured to cartridge body 102, as in FIG. 3. Toner moving within the outlet passageway 118 to contact the OPC 104 is prevented from exiting the toner chamber 110 by seals 116A. Seals 116A are preferably manufactured from a resilient, flexible material such as elastomeric rubber or plastic, so that they can be temporarily deformed by a force acting on them (such as a force induced by an increase in pressure within the chamber 110), yet return to a base shape once the force acting on them has been removed. As can be seen, seals 116A are curved inward towards outlet channel 118. Accordingly, as pressure within the chamber 110 is increased, a force "S" will press the tips 117 of the sealing members 116A tighter against the OPC 104. Once the pressure within the chamber 110 is reduced, the tips 117 of the sealing members 116A will resume their normal shape, allowing free operation of the OPC. Since it is extremely unlikely that a user will check the level of the imaging substance in the cartridge while the cartridge is being used to produce an image, it does not matter whether the seals 116A, in their deformed state (resulting from a temporary increase in pressure within the chamber 110) might inhibit free rotation of the OPC 104.

Figure 11:
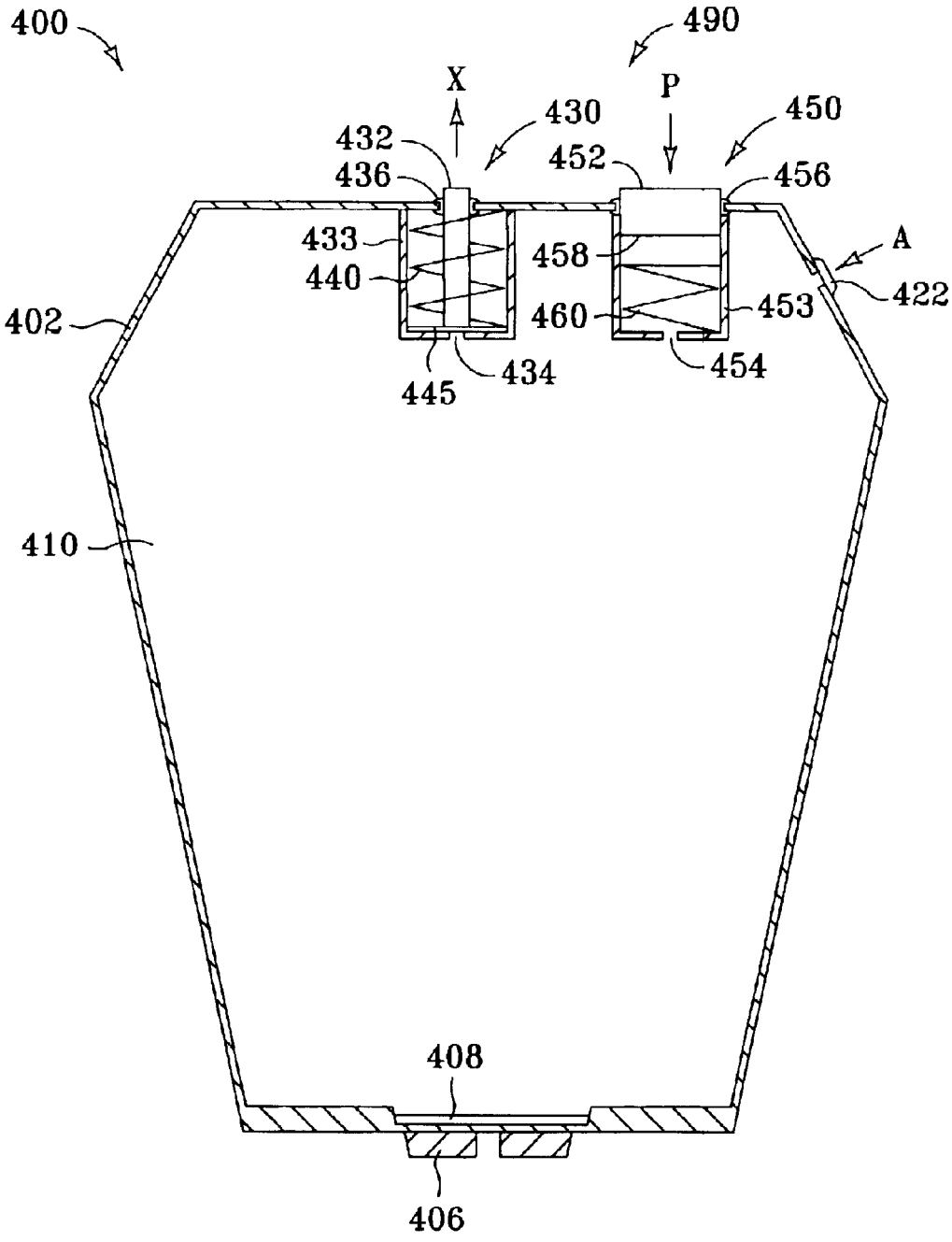
FIG. 11 is a side elevation sectional view of an ink cartridge having an ink level indication device in accordance with an embodiment of the present invention.

Although examples of the apparatus of the present invention have thus far been described with respect to imaging substance cartridges wherein the imaging substance is toner (and the cartridge is thus a "toner cartridge"), the present invention is equally applicable to imaging cartridges wherein the imaging substance is a liquid ink (and therefore the imaging substance cartridge is an "ink cartridge"). In this latter embodiment the cartridge body defines an ink chamber configured to contain liquid ink therein, and the imaging substance level indication device is an ink level indication device. One example of an ink level indication device in accordance with the present invention is depicted in FIG. 11. FIG. 11 depicts a side elevation sectional view of an ink cartridge 400 which includes an ink level indication device 490. The ink cartridge 400 includes an ink distribution system 406 which allows ink in the chamber 410 of the ink cartridge 400 to be distributed onto imaging media by any ink distribution process (e.g., thermal ink jet distribution, or piezoelectric ink distribution, both of which are known in the art). An ink flow membrane 408 can control the flow of ink from the chamber 410 to the ink distribution system 406, much in the manner that seals 116 (FIG. 3) restrict flow of toner outside of the toner chamber 110. A unidirectional valve 422 can allow ambient air "A" to enter the cartridge 400 as ink is removed from the cartridge, but resists movement of vapor out of the ink chamber 410.

The ink level indication device 490 of FIG. 11 includes an ink level indication actuator 450 which is supported in the cartridge body 402 and which is configured to displace a vapor volume within the ink chamber 410, all as described with respect to the toner level indication actuator 150 of FIG. 3. That is, ink level indication actuator 450 includes a piston 452 supported in the cartridge body 402. As depicted in FIG. 11, the piston 452 can be moveable from a first position (as depicted) to a second position (similar to 152*a* shown by dashed lines in FIG. 4). When the piston 452 is moved in direction "P" from the first position to the second position, the piston moves into the imaging substance chamber 410 to thereby displace a vapor volume in the chamber 410. As shown in FIG. 11, the level indication actuator 450 can further include an actuator sleeve 453 supported by the cartridge body 402. Actuator sleeve 453 receives piston 452 and supports the piston within the imaging substance chamber 410. An opening 454 in the bottom of the sleeve 453 allows vapor within the chamber 410 to move out of the central opening defined by the sleeve 453, responsive to movement of the piston 452 from the first position to the second position. The opening 454 also allows vapor to move from the chamber 410 into the central opening in the sleeve 453 when the piston 452 is returned to the first position. The level indication actuator 450 can also be provided with an actuator vapor seal 456 which is disposed between the piston 452 and the cartridge body 402 to contain vapor (and ink) within the imaging substance chamber 410. A secondary seal can also be provided, such as o-ring 458 which fits around the piston 452 and contacts the inner surface of sleeve 453. The level indication actuator 450 is preferably provided with an actuator biasing member (spring 460) in contact with the piston 452 and configured to urge the piston to the first position (i.e., out of the imaging substance chamber 410). In this way, after a user presses the actuator piston 452 down in the "P" direction and then releases the piston, it will be returned to the first position. Piston 452 can be secured in the sleeve 453 by a restraining member, similar to pin 157 (FIG. 4) which is supported on the inner surface of sleeve 153 and fits within a delimited slot 159 in the piston. In addition to the embodiment of level indication actuator indicator 450 depicted in FIG. 11, any of the other embodiments of a level indication actuator described above with respect to a toner cartridge can also be used for the ink cartridge embodiment.

The ink level indication system 490 of FIG. 11 also includes an ink level indicator 430 supported by the cartridge body 402 and which is responsive to the displacement of vapor volume within the ink chamber 410 (resulting from activation of the ink level indication actuator 450). The ink level indicator can take the form of any of the imaging substance level indicators described above (e.g., level indicator 130, FIGS. 3 through 5, indicator 230 of FIGS. 7 and 8, level indicator 330 of FIG. 10, and level indicator 530 (FIG. 12). As depicted, the ink level indicator 430 of FIG. 11 is configured similarly to the toner level indicator 130 of FIG. 3. That is, ink level indicator 430 of FIG. 11 can comprise an elongated member 432 moveably supported in the ink cartridge body 402. The elongated member 432 has a first end 445 exposed to the imaging substance chamber 410, such that a pressure increase within the imaging substance chamber 410 will cause the elongated member 432 to move within the cartridge body 402. This type of movement was described above with respect to indicator 130 of FIG. 3, and in general is the movement which is responsive to the displacement of vapor volume in the chamber 410 due to moving the actuator 450 from the first position to the second position, as described above with respect to actuator 150 of FIG. 3 (see description of actuator 150 with respect to FIGS. 4, 6A and 6B). Similar to the piston 452, the ink level indicator 430 can include an indicator vapor seal 436 which is placed between the elongated member 432 and the cartridge body 402, to thereby contain vapor (and ink) within the imaging substance chamber 410. The ink level indicator 430 can further include an indictor sleeve 433 supported by the cartridge body 402. Indicator sleeve 433 receives the elongated member 432 and supports the elongated member within the imaging substance chamber 410. An opening 434 in the bottom of the sleeve 433 allows vapor within the chamber 410 into the central opening defined by the sleeve 433, responsive to an increase of pressure within the chamber 410. This movement of vapor into the sleeve 433 causes the elongated member 432 to move in direction "X" from a first position (depicted in FIG. 11) to a second position (similar to the depiction of elongated member 132 in FIGS. 6A and 6B). The opening 434 also allows vapor to move from the central opening in the sleeve 433 into the chamber 410 when the elongated member 432 is returned to the first position (i.e., the position depicted in FIG. 11). The level indicator 430 is preferably provided with an indicator biasing member (spring 440) in contact with the elongated member 432 and configured to urge the elongated member to the first position (i.e., into the imaging substance chamber 410). As depicted, the spring 440 acts against the cartridge body 402 and a flange 445 which is attached to the bottom of the elongated member 432. In this way, after a user releases the actuator piston 452 from the second position (the "depressed" position, similar to actuator 152*a* of FIG. 4), the elongated member 432 will be returned to its first position (depicted in FIG. 11). The elongated member 432 can be secured in the sleeve 433 by a restraining member, such as flange 445.

Figure 15A:
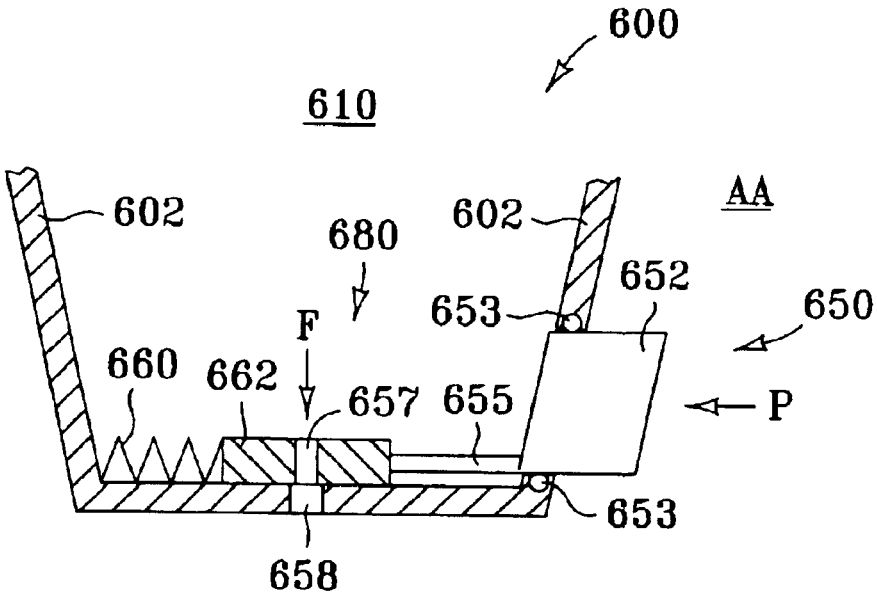
FIGS. 15A and 15B depict a side elevation sectional view of an ink cartridge having an ink level indication actuator in accordance with an embodiment of the present invention.
Figure 15B:
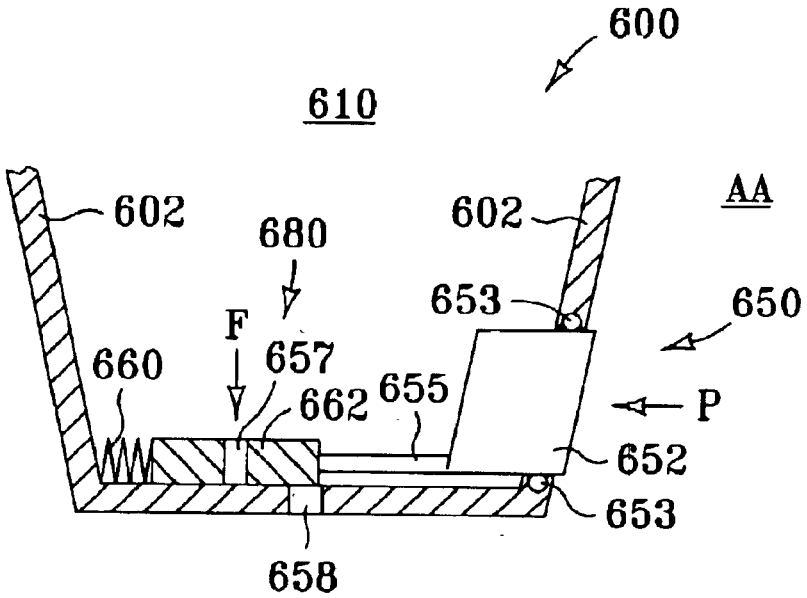

As with the seals 116 (FIG. 3) and 116A (FIG. 13) that tend to contain toner within the toner cartridge 100 of FIG. 3 against an increase of pressure within the toner chamber 110, preferably the ink cartridge 400 of FIG. 11 includes similar seals to contain liquid ink within the ink chamber 410 when the ink level actuator 450 is actuated. One example of such a seal is depicted in FIGS. 15A and 15B. As seen in FIG. 15A, the ink cartridge 600 has an ink cartridge body 602 which defines an ink outlet 658. The ink outlet 658 allows liquid ink within the ink chamber 610 to pass from the ink chamber 610 to an ink distribution system (not shown), thereby allowing the liquid ink to be applied to imaging media. In the embodiment depicted in FIG. 15A, the ink level indication device comprises an ink outlet seal 680 in communication with the ink level indication actuator 650, and configured to seal the ink outlet 658 when the ink level indication actuator 650 displaces the vapor volume within the ink chamber 610. More specifically, the ink level indication device includes an ink level indication actuator 650, which comprises a piston 652. Piston 652 is supported in the ink cartridge body 602, and is moveable from a first position (as depicted in FIG. 15A) to a second position (as depicted in FIG. 15B). When the piston 652 is moved from the first position (FIG. 15A) to the second position (FIG. 15B), the piston 652 moves into the ink chamber 610 to thereby displace a vapor volume within the ink chamber 610. This causes the ink level indicator (such as 430, FIG. 11) to act in response to the pressure increase within chamber 610, and thus present an indication of the level of ink within the chamber 610.

The actuator piston 652 can be sealed to the cartridge body 602 by seal 653 (such as an o-ring) to thereby maintain an air/liquid seal between the ink chamber 610 and the ambient environment "AA" outside of the ink cartridge 600. Further, the ink cartridge 600 can be provided with an ink outlet seal 680 to mitigate against migration of liquid ink in direction "F" (FIG. 15A) from the ink outlet 658 when the pressure within the ink chamber 610 is increased due to actuation of the level actuator 650. In the embodiment depicted in FIGS. 15A and 15B, the ink outlet seal 680 comprises a moveable sealing member 662 connected to the piston 652. The moveable sealing member 662 comprises an opening 657 configured to align with the ink outlet opening 658 when the piston 652 is in the first position (FIG. 15A), and to be moved out of alignment with the ink outlet 658 when the piston 652 is in the second position (FIG. 15B), to thereby seal the ink outlet 658. The sealing member 662 can be connected to the actuation piston 652 via connecting member 655. Further, the ink outlet seal 680 can comprise a biasing member (such as spring 660) to bias the sealing member 662 to the open position (so that liquid ink can migrate out of the ink chamber 610 during normal usage).

Another embodiment of the present invention provides for a method of determining the approximate level of imaging substance (e.g., toner or liquid ink) within an imaging substance cartridge (e.g., a toner cartridge such as cartridge 100 of FIG. 3, or an ink cartridge such as cartridge 400 of FIG. 11). The imaging substance cartridge preferably defines an essentially sealed imaging substance chamber (e.g., toner chamber 110 of FIG. 3, or ink chamber 410 of FIG. 11) defined by a volume and at least partially occupied by a vapor (such as air and/or a vapor evolved from the imaging substance). The method includes temporarily decreasing the volume of the imaging substance chamber (e.g., chamber 110 (FIG. 3) or 410 (FIG. 11) to thereby produce an increase in pressure of the vapor within the imaging substance chamber. An example of this was described above with respect to FIGS. 6A and 6B, wherein movement of the piston 152 into chamber 110 produced an increase in pressure within the chamber 110. The method further includes measuring the increase in pressure of the vapor within the imaging substance chamber (such as by use of any of the level indicators 130, 230, 330, 430, described above). The method then includes displaying the measured increase in pressure of the vapor within the imaging substance chamber. As described above, the measured increase in pressure (and thus an approximation of the level of imaging substance within the cartridge) can be displayed for visual inspection by using a visual indicator, such as the "pop-up" elongated member 132, 332 and 432 of FIGS. 3, 5, 10 and 11, as well as a "sliding member", such as 232 and 532 of FIGS. 7, 8 and 12.

The method can further include correlating the measured increase in pressure of the vapor within the imaging substance chamber (e.g., chambers 110, 210, 310, 410, 510, 610) to an approximate level of imaging substance within the imaging substance chamber. For example, the elongated member 132 (which acts to measure the increase in pressure in toner chamber 110 of FIG. 3) can be associated with the indicia "F" through "E" (as in FIG. 5) to provide a correlation of the measured pressure (as measured by the level indicator 130 of FIG. 3) to approximate the level of imaging substance within the imaging substance chamber (110). Likewise, the sliding member 232 of FIG. 8 (which acts to measure the increase in pressure in toner chamber 210 of FIG. 7) can be associated with the indicia "F" through "E" (as in FIG. 8) to provide a correlation of the measured pressure (as measured by the level indicator 230 of FIG. 7) to approximate the level of imaging substance within the imaging substance chamber 210.

The method further provides for temporarily decreasing the volume of the imaging substance chamber by temporarily moving a volume displacing element into the imaging substance chamber. For example, the volume displacing member can be piston 152 which moves into chamber 110 (as depicted in FIGS. 6A and 6B), as well as pistons 252 (FIG. 7), 352 (FIG. 9) and 452 (FIG. 11), diaphragm 552 (FIG. 14), and member 652 (FIGS. 15A and 15B). In the method, the increase in pressure of the vapor within the imaging substance chamber (e.g., chambers 110, 210, 310, 410, 510 and 610) can be measured by a pressure sensitive moveable element (e.g., elongated members 132, 332 and 432, as well as slidable elements 232 and 532) which moves in response to the increase in pressure of the vapor within the imaging substance chamber.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An imaging substance cartridge comprising a cartridge body defining an imaging substance chamber configured to contain imaging substance, and an imaging substance level indication device, the imaging substance level indication device comprising:

a level indication actuator supported in the cartridge body and which is configured to displace a vapor volume within the imaging substance chamber; and an imaging substance level indicator supported by the cartridge body and which is responsive to the displacement of vapor volume within the imaging substance chamber.

2. The imaging substance cartridge of claim 1, and wherein the level indication actuator comprises a piston supported in the cartridge body, and which is moveable from a first position to a second position, and when moved from the first position to the second position, the piston moves into the imaging substance chamber to thereby displace the vapor volume within the imaging substance chamber.

3. The imaging substance cartridge of claim 1, and wherein the imaging substance level indicator comprises an elongated member moveably supported in the cartridge body, the elongated member having a first end exposed to the imaging substance chamber such that a pressure increase within the imaging substance chamber causes the elongated member to move within the cartridge body.

4. The imaging substance cartridge of claim 1, and wherein the imaging substance level indicator comprises a sliding member slidably supported by the cartridge body, the sliding member having a first end exposed to the imaging substance chamber such that a pressure increase within the imaging substance chamber causes the sliding member to move with respect to the cartridge body.

5. An imaging substance cartridge comprising:

a cartridge body defining an imaging substance chamber configured to contain imaging substance; and, an imaging substance level indication device, the imaging substance level indication device comprising:

a level indication actuator supported in the cartridge body and which is configured to displace a vapor volume within the imaging substance chamber, wherein the level indication actuator comprises a piston supported in the cartridge body, and which is moveable from a first position to a second position, and when moved from the first position to the second position, the piston moves into the imaging substance chamber to thereby displace the vapor volume within the imaging substance chamber; and, an imaging substance level indicator supported by the cartridge body and which is responsive to the displacement of vapor volume within the imaging substance chamber; and an actuator vapor seal between the piston and the cartridge body to contain vapor within the imaging substance chamber.

6. The imaging substance cartridge of claim 5, and further comprising an actuator sleeve supported within the imaging substance chamber by the cartridge body, and wherein the piston is received within the actuator sleeve.

7. The imaging substance cartridge of claim 5, and further comprising an actuator biasing member in contact with the piston and configured to urge the piston out of the imaging substance chamber.

8. An imaging substance cartridge comprising:

a cartridge body defining an imaging substance chamber configured to contain imaging substance; and, an imaging substance level indication device, the imaging substance level indication device comprising:

a level indication actuator supported in the cartridge body and which is configured to displace a vapor volume within the imaging substance chamber, wherein the level indication actuator comprises a piston supported in the cartridge body, and which is moveable from a first position to a second position, and when moved from the first position to the second position, the piston moves into the imaging substance chamber to thereby displace the vapor volume within the imaging substance chamber; and, an imaging substance level indicator supported by the cartridge body and which is responsive to the displacement of vapor volume within the imaging substance chamber; and, an actuator bellows disposed between the piston and the imaging substance chamber, the actuator bellows being vapor sealed to the imaging substance chamber.

9. An imaging substance cartridge comprising:

a cartridge body defining an imaging substance chamber configured to contain imaging substance; and, an imaging substance level indication device, wherein the cartridge body is defined by an outer surface and the level indication actuator comprises a diaphragm biased to protrude outward from the cartridge body outer surface, and which is moveable to intrude within the imaging substance chamber, the imaging substance level indication device comprising:

a level indication actuator supported in the cartridge body and which is configured to displace a vapor volume within the imaging substance chamber; and, an imaging substance level indicator supported by the cartridge body and which is responsive to the displacement of vapor volume within the imaging substance chamber.

10. An imaging substance cartridge comprising:

a cartridge body defining an imaging substance chamber configured to contain imaging substance; and, an imaging substance level indication device, wherein the imaging substance level indicator comprises an elongated member movably supported in the cartridge body, the elongated member having a first end exposed to the imaging substance chamber such that a pressure increase within the imaging substance chamber causes the elongated member to move within the cartridge body; and, an indicator vapor seal between the elongated member and the cartridge body to contain vapor within the imaging substance chamber.

11. The imaging substance cartridge of claim 10, and further comprising an indicator sleeve supported within the imaging substance chamber by the cartridge body, and wherein the elongated member is received within the indicator sleeve.

12. The imaging substance cartridge of claim 10, and further comprising an indicator biasing member in contact with the elongated member and configured to urge the elongated member into the imaging substance chamber.

13. An imaging substance cartridge comprising:

a cartridge body defining an imaging substance chamber configured to contain imaging substance; and, an imaging substance level indication device, wherein:

the imaging substance level indicator comprises an elongated member movably supported in the cartridge body, the elongated member having a first end exposed to the imaging substance chamber such that a pressure increase within the imaging substance chamber causes the elongated member to move within the cartridge body; and, the cartridge body is defined by an outer surface, and the elongated member has a second end which moves away from the cartridge body outer surface when the elongated member moves in response to an increase in pressure within the imaging substance chamber.

14. The imaging substance cartridge of claim 13, and wherein the elongated member is defined by a length which can protrude beyond the cartridge body, and further wherein the elongated member is marked in graduations along the length which are indicative of a level of imaging substance contained within the imaging substance chamber.

15. An imaging substance cartridge comprising:

a cartridge body defining an imaging substance chamber configured to contain imaging substance;

an imaging substance level indication device, the imaging substance level indication device comprising:

a level indication actuator supported in the cartridge body and which is configured to displace a vapor volume within the imaging substance chamber; and an imaging substance level indicator supported by the cartridge body and which is responsive to the displacement of vapor volume within the imaging substance chamber, wherein the imaging substance level indicator comprises an elongated member movably supported in the cartridge body, the elongated member having a first end exposed to the imaging substance chamber such that a pressure increase within the imaging substance chamber causes the elongated member to move within the cartridge body; and an indicator bellows disposed between the elongated member and the imaging substance chamber, the indicator bellows being vapor sealed to the imaging substance chamber.

16. An imaging substance cartridge comprising:

a cartridge body defining an imaging substance chamber configured to contain imaging substance;

a unidirectional vent valve supported in the cartridge body to allow air to enter the imaging substance chamber; and, an imaging substance level indication device, comprising:

a level indication actuator supported in the cartridge body and which is configured to displace a vapor volume within the imaging substance chamber; and an imaging substance level indicator supported by the cartridge body and which is responsive to the displacement of vapor volume within the imaging substance chamber.

17. An imaging substance cartridge comprising:

a cartridge body defining an imaging substance chamber configured to contain imaging substance; and, an imaging substance level indication device, comprising:

a level indication actuator supported in the cartridge body and which is configured to displace a vapor volume within the imaging substance chamber;

an imaging substance level indicator supported by the cartridge body and which is responsive to the displacement of vapor volume within the imaging substance chamber;

a first magnet connected to the imaging substance level indicator; and, a second magnet moveably supported within the imaging substance chamber and in proximity to the first magnet, the second magnet movable in response to the displacement of volume within the imaging substance wherein the imaging substance level indicator is moveably supported by the cartridge body.

18. A toner cartridge comprising a cartridge body defining a toner chamber configured to contain toner therein, and a toner level indication device, the toner level indication device comprising:

a toner level indication actuator supported in the cartridge body and which is configured to displace a vapor volume within the toner chamber; and a toner level indicator supported by the cartridge body and which is responsive to the displacement of vapor volume within the toner chamber.

19. A toner cartridge comprising:

a cartridge body defining a toner chamber configured to contain toner therein;

an optical photoconductor (OPC) supported by the cartridge body and in communication with the toner chamber;

an OPC seal between the OPC and the cartridge body to seal the toner chamber, the OPC seal configured to apply an increased sealing force between the OPC and the toner chamber in response to an increase in pressure within the toner and a toner level indication device, the toner level indication device comprising:

a toner level indication actuator supported in the cartridge body and which is configured to displace a vapor volume within the toner chamber;

a toner level indicator supported by the cartridge body and which is responsive to the displacement of vapor volume within the toner chamber.

20. The toner cartridge of claim 19, and wherein the OPC seal comprises an elastomeric member configured to deform and press against the OPC in response to the increase in pressure within the toner chamber.

21. An ink cartridge comprising a cartridge body defining an ink chamber configured to contain liquid ink therein, and an ink level indication device, the ink level indication device comprising:

an ink level indication actuator supported in the cartridge body and which is configured to displace a vapor volume within the ink chamber; and an ink level indicator supported by the cartridge body and which is responsive to the displacement of volume within the ink chamber.

22. An ink cartridge comprising:

a cartridge body defining an ink chamber configured to contain liquid ink therein and wherein the cartridge body defines an ink outlet; and, an ink level indication device, the ink level indication device comprising:

an ink level indication actuator supported in the cartridge body and which is configured to displace a vapor volume within the ink chamber;

an ink level indicator supported by the cartridge body and which is responsive to the displacement of volume within the ink chamber; and, an ink outlet seal in communication with the ink level indication actuator and configured to seal the ink outlet when the ink level indication actuator displaces the vapor volume within the chamber.

23. The ink cartridge of claim 22, and wherein:

the ink level indication device comprises a piston supported in the cartridge body, and which is moveable from a first position to a second position, and when moved from the first position to the second position, the piston moves into the ink chamber to thereby displace the vapor volume within the ink chamber;

the ink outlet seal comprises a moveable sealing member connected to the piston, the moveable sealing member comprising an opening configured to align with the ink outlet when the piston is in the first position, and to be moved out of alignment with the ink outlet when the piston is in the second position, to thereby seal the ink outlet.

24. A method of determining the approximate level of imaging substance within an imaging substance cartridge, the imaging substance cartridge defining an essentially sealed imaging substance chamber defined by a volume and at least partially occupied by a vapor, comprising:

temporarily decreasing the volume of the imaging substance chamber to thereby produce an increase in pressure of the vapor within the imaging substance chamber;

measuring the increase in pressure of the vapor within the imaging substance chamber; and displaying the measured increase in pressure of the vapor within the imaging substance chamber.

25. The method of claim 24, and further comprising correlating the measured increase in pressure of the vapor within the imaging substance chamber to an approximate level of imaging substance within the imaging substance chamber.

26. A method of determining the approximate level of imaging substance within an imaging substance cartridge, the imaging substance cartridge defining an essentially sealed imaging substance chamber defined by a volume and at least partially occupied by a vapor, the method comprising:

temporarily decreasing the volume of the imaging substance chamber to thereby produce an increase in pressure of the vapor within the imaging substance chamber, wherein the volume of the imaging substance chamber is temporarily decreased by temporarily moving a volume displacing element into the imaging substance chamber;

measuring the increase in pressure of the vapor within the imaging substance chamber; and, displaying the measured increase in pressure of the vapor within the imaging substance chamber.

27. A method of determining the approximate level of imaging substance within an imaging substance cartridge, the imaging substance cartridge defining an essentially sealed imaging substance chamber defined by a volume and at least partially occupied by a vapor, the method comprising:

temporarily decreasing the volume of the imaging substance chamber to thereby produce an increase in pressure of the vapor within the imaging substance chamber;

measuring the increase in pressure of the vapor within the imaging substance chamber, wherein the increase in pressure of the vapor within the imaging substance chamber is measured by a pressure sensitive movable element which moves in response to the increase in pressure of the vapor within the imaging substance chamber; and, displaying the measured increase in pressure of the vapor within the imaging substance chamber.

28. The method of claim 27, and wherein the increase in pressure of the vapor within the imaging substance chamber is displayed by presenting the pressure sensitive moveable element for visual inspection.

29. The method of claim 27, and wherein the increase in pressure of the vapor within the imaging substance chamber is displayed by tracking the movement of the pressure sensitive moveable element with a level indicator, and presenting the level indicator for visual inspection.

* * * * *

UNITED STATES PATENT AND TRADEMARK OFFICE

CERTIFICATE OF CORRECTION

PATENT NO. : 6,793,331 B2
DATED : September 21, 2004
INVENTOR(S) : Anderson et al.

It is certified that error appears in the above-identified patent and that said Letters Patent is hereby corrected as shown below:

Column 19,
Lines 53 and 67, delete “and” and insert therefor -- and, --.

Column 20,
Line 22, after “stance”, insert -- chamber, --.
Line 45, delete “toner and” and insert therefor -- toner; and, --.

Signed and Sealed this

Twelfth Day of April, 2005

JON W. DUDAS
*Director of the United States Patent and Trademark Office*